United States Patent [19]

Resler, Jr.

[11] 4,413,593

[45] Nov. 8, 1983

[54] COMBUSTION CONTROL BY PRESTRATIFICATION

[75] Inventor: Edwin L. Resler, Jr., Ithaca, N.Y.

[73] Assignee: Cornell Research Foundation, Inc.

[21] Appl. No.: 326,237

[22] Filed: Dec. 1, 1981

Related U.S. Application Data

[63] Continuation-in-part of Ser. No. 163,898, Jun. 27, 1980, abandoned, which is a continuation-in-part of Ser. No. 140,932, Apr. 16, 1980, abandoned.

[51] Int. Cl.[3] ..... F02B 17/00; F02M 25/06; F02B 27/08

[52] U.S. Cl. ..... 123/1 A; 123/274; 123/430; 123/568; 60/597; 60/605; 60/606

[58] Field of Search ..... 123/568, 274, 430, 1, 123/1 A; 60/597, 605, 606

[56] References Cited

U.S. PATENT DOCUMENTS

| | | | |
|---|---|---|---|
| 2,652,040 | 3/1941 | Tritt | 123/119 |
| 3,092,988 | 6/1963 | Goossak et al. | 123/41.31 |
| 3,283,751 | 11/1966 | Goossak et al. | 123/32 |
| 3,799,130 | 3/1974 | Dahlstrom | 123/119 A |
| 3,810,454 | 5/1974 | Hunt | 123/430 |
| 4,064,849 | 12/1977 | Nagasawa | 123/430 |
| 4,104,988 | 8/1979 | Resler, Jr. | 123/430 |
| 4,119,074 | 10/1978 | Hattori | 123/119 A |
| 4,135,481 | 1/1979 | Resler, Jr. | 123/568 |
| 4,261,316 | 4/1981 | Motosugi et al. | 123/568 |
| 4,262,639 | 4/1981 | Motosugi et al. | 123/52 M |

OTHER PUBLICATIONS

Datsun Discovery vol. 3, No. 3, pp. 29–30, Fall, 1979.
Cornell Engineer vol. 45, No. 1, Oct. 1979.
Road Test pp. 32–34, Dec. 1979.

*Primary Examiner*—Wendell E. Burns
*Attorney, Agent, or Firm*—Jones, Tullar & Cooper

[57] ABSTRACT

Combustion control in a spark ignited internal combustion engine for inhibition of incipient detonation, or knock, is provided by the addition of exhaust gases or other diluent gases to the intake manifold of the engine prior to opening of the intake valve. The addition of this diluent gas causes a prestratification of the charge entering the combustion chamber of the engine. Upon compression and ignition of the charge, the diluent gas inhibits spontaneous combustion of the portions of the charge furthest away from the site of ignition of the charge, thereby preventing one cause of incipient detonation. This combustion control may be used with turbocharged and supercharged engines, as well as with naturally aspirated internal combustion engines, and allows the engine to operate on much lower octane fuel than would be possible without prestratification.

14 Claims, 3 Drawing Figures

COMBUSTION CONTROL BY PRESTRATIFICATION

CROSS REFERENCE TO RELATED APPLICATIONS

This application is a continuation-in-part of U.S. patent application, Ser. No. 163,898 filed June 27, 1980, which was in turn, a continuation-in-part of Ser. No. 140,932 filed Apr. 16, 1980, now abandoned.

FIELD OF THE INVENTION

The present invention is directed generally to the control of combustion in a spark ignition internal combustion engine by the use of charge prestratification. More specifically, the present invention is directed to combustion control by exhaust gas prestratification of the charge in the intake manifold of a naturally aspirated or of a supercharged engine, whereby the prestratified charge in the portion of the cylinder away from the spark source is rendered much less apt to combust spontaneously, thereby eliminating knock or detonation.

In accordance with the invention, exhaust gas or other diluent gas is continuously or intermittently introduced under pressure into the intake manifold of an engine at a location generally adjacent the intake port of a cylinder to selectively dilute the charge which is to be inducted into the cylinder on the intake stroke. The charge in the intake manifold may be supplied through a compressor stage of a supercharger, and may be an air-fuel mixture in the case of a carbureted engine, or in the case of a fuel injected engine may be an air-fuel mixture or air only, depending on the fuel injector location. While the intake valve is closed, the gas dilutes the portion of the charge which is located in the region of the intake port to form a pocket of diluted charge adjacent the port and to prestratify the charge. Upon opening of the intake valve, the accumulated diluted charge is admitted into the engine cylinder first and is followed by the undiluted portion of the charge to produce a stratified charge in the cylinder. The prestratification of the charge in the intake manifold, and its maintenance within the cylinder during compression allows the engine to operate efficiently without ping or knock and to operate on fuel having a substantially lower octane rating than would be possible without the combustion control by prestratification in accordance with the present invention.

DESCRIPTION OF THE PRIOR ART

The efficiency of an internal combustion engine operating on the Otto cycle is dependent, to a large degree, on the compression ratio of the engine. However, as is apparent to most automobile drivers, the use of low octane fuel in a high compression engine produces what is commonly called knock and ping. This knock can be caused by the premature spontaneous combustion of a portion of the charge in the cylinder of an engine and can, if permitted to continue, destroy the engine.

Until relatively recently, the octane ratings of gasoline were increased by the addition of fuel additives such as tetra-ethyl lead and the like to permit their use in high compression engines. Recent pollution control requirements have eliminated the use of such octane improving additives, however, and the automotive industry has been required to rely on lower compression ratio engines which will operate on the lower octane rating unleaded gasolines currently being refined. The use of lower compression ratios has produced less efficient engines, which have not been readily accepted by the driving public. Furthermore, the increased refining costs associated with the production of unleaded gasoline having a sufficiently high octane rating to perform in currently available high compression engines, together with the increased costs of crude oil and its questionable availability, has substantially raised the price of gasoline and has given added impetus to the search for alternate fuels and to methods for using available fuel more efficiently.

In response to the drive to reduce air pollution, the present day conventional internal combustion engine has been subjected to a number of restrictions which have required the addition of "bolt on" hardware, which is aimed at reducing chemical pollutants produced during operation. Devices such as catalytic converters, air pumps, exhaust gas recirculation valves, and the like, have been added to the basic engine. The inventor herein has been active in the field of pollution reduction for internal combustion engines and has several patents directed to prestratification of engine charges for this purpose. U.S. Pat. Nos. 4,104,989 and 4,135,481, both describe the introduction of a gas into the intake manifold of an engine at a point between the throttle valve and the intake valve. This gas acts to prestratify the charge prior to its entry into the working cylinder for the purpose of reducing the pollution emitted by the engine.

The prior art also teaches that exhaust gas recirculation (EGR) may be applied to engines for pollution control by introducing exhaust gases into the intake manifold at a point directly below the throttle plate of the carburetor. This exhaust gas recirculation causes uniform dilution of the air-fuel mixture. Such EGR systems are disclosed in U.S. Pat. No. 3,625,189 to Myers, U.S. Pat. No. 3,809,039 to Alqeust; U.S. Pat. No. 3,980,618 to Tange et al; and U.S. Pat. No. 3,941,105 to Yagi et al.

Since pollution control remains an important factor in internal combustion engine design, the expense of refining fuels having an octane rating sufficiently high to permit use in high compression engines has led to a reduced availability of such fuels, and has created a serious problem for the users of these engines. The problem is particularly acute for users of aviation gasoline, which is becoming scarce in remote areas. Aircraft engines, particularly those in smaller aircraft, are high compression, and do not operate well on low octane fuels. However, in many areas the only fuel available is kerosene, which is suitable for jet aircraft engines but is not usable in conventional internal combustion engines. Although many attempts have been made to find a way to operate conventional high compression engines on low octane fuel, this has not been accomplished successfully in the prior art.

With the present move toward lower displacement engines in an attempt to conserve fuel, the problems created by pollution control devices become acute, for those control devices require a greater proportion of the power output available from such engines than was the case with larger engines. Thus, the need for smaller, fuel-efficient engines is at variance with the desire to control pollution. Attempts have been made to restore some of the lost power from these smaller engines through the use of engine superchargers, which function to increase the pressure within the engine cylinder. However, such devices do not solve the problem caused by low octane fuel, and in fact add to that problem, since the high pressures produced in the engine can contribute to detonation, or knock.

Thus, the current state of the art of spark ignition internal combustion engines is restricted by the interaction of octane ratings of the fuel available and the limit this rating places on compression ratios which will accept this fuel without knock. Increased fuel combustion efficiencies require increased compression ratios, and could be helped by supercharging, but limitations on the octane rating of the fuels which can reasonably be refined place an upper limit on compression ratios. Alternate fuels, such as coal, oil, or kerosene, are of such a low octane rating that they cannot be used in the internal combustion engines currently available. Accordingly, a solution is sought which will allow the use of currently available gasoline in higher compression ratio naturally aspirated or supercharged engines, or which will allow the use of low octane fuels, which could be produced from domestic resources such as coal or oil shale, in engines currently in use or being produced.

SUMMARY OF THE INVENTION

It is an object of the present invention to control combustion in a spark ignition internal combustion (I.C.) engine.

Another object of the present invention is to control combustion in a naturally aspirated or in a supercharged engine by prestratification of a charge prior to its delivery to an engine cylinder.

A further object of the present invention is to utilize exhaust gas to prestratify a charge prior to introduction of the charge into an engine cylinder, thereby to obtain a controlled combustion within the cylinder.

Yet another object of the present invention is to improve the efficiency of an I.C. engine by charge prestratification and by maintenance of such prestratification during charge compression.

Still a further object of the invention is to reduce the octane rating of the fuel required by an I.C. engine through charge prestratification.

It is also an object of the present invention to inhibit knock or ping in a supercharged I.C. engine through combustion control by charge prestratification.

As will be discussed in greater detail hereinafter in the description of the preferred embodiments, combustion control in a naturally aspirated or in a supercharged spark ignition internal combustion engine is accomplished in accordance with the subject invention by prestratification of the charge to the cylinder. This prestratification is accomplished by the introduction of diluent exhaust gas into the intake manifold at a point adjacent the intake valve. While this valve is closed, the exhaust gas accumulates in the region of the intake port, and dilutes the portion of the charge in the manifold. Upon opening of the intake valve, this is the first portion of the charge inducted into the cylinder. The remaining portion of the charge is then inducted through the intake manifold to complete the charge, and the charge is compressed and ignited. The charge thus is stratified in the intake manifold by the introduction of the exhaust gas or other diluent prior to its induction into the cylinder, and remains essentially stratified in the cylinder during compression and combustion.

The diluted portion of the charge, containing the exhaust gas, flows into the cylinder first, and is deposited at a location furthest away from the spark plug, generally adjacent the piston. This portion of the combustion chamber usually contains the end gases which are the most subject to incipient detonation or knock. By using prestratification with exhaust gas or other diluent, the combustible gases are prevented from burning until the flame front created by the spark ignition reaches them, and the tendency of the engine to knock is eliminated or substantially reduced.

As was discussed previously, since efficiency is related to compression ratio, and since higher compression ratios provoke knock, reduction of the octane rating of available fuel has created a serious problem in existing engines. However, the combustion control by prestratification, in accordance with the present invention, permits two interrelated solutions to this problem. First, by use of the invention, the compression ratio of an engine can be increased while still operating on available octane rating gasoline. Since the engine efficiency is increased, the result is better utilization of the fuel. Second, and alternatively, with the invention the compression ratio of the engine is not altered, but the octane requirement of the fuel used in the engine is substantially reduced. Thus, a low octane fuel, such as kerosene or coal oil, can be utilized in a readily available engine which has been fitted with the charge prestratification of the present invention. Since domestic supplies of coal and oil-bearing shale are large, the application of combustion control by prestratification, in accordance with the present invention, would result in a significant reduction on the dependence on other than domestic energy sources.

In brief, then, in a preferred form the present invention is directed to a method of controlling incipient detonation and increasing the efficiency of combustion in an internal combustion engine by prestratification of the charge in such a way that a low octane fuel may be used in an engine having a compression ratio which exceeds the "permissible compression ratio" of the fuel. This is accomplished in a carbureted engine by supplying a fuel-air mixture to the intake manifold of the engine at a first pressure, the fuel having an octane rating which would normally not be operable in the engine without incipient detonation. A diluting gas, such as recirculated exhaust gas, is fed to the intake manifold at a location near the intake port, or intake valve, of the engine. This diluting gas is at a second pressure higher than the pressure of the fuel-air mixture, so as to dilute the fuel-air mixture in the region of the intake port. With the intake port closed, a pocket of diluted fuel-air mixture is formed which, with the undiluted fuel-air mixture in the portion of the intake manifold remote from the intake port, produces a prestratified charge for the engine.

When the intake valve opens, the prestratified charge is fed into the cylinder during the intake stroke. The diluted portion of the charge enters first and is located near the face of the piston. The undiluted portion of the charge follows, and completes the cylinder charge, but the stratification remains intact.

Ignition occurs after closure of the intake valve and after the compression stroke, producing a flame front which moves through the cylinder, from the spark plug toward the diluted portion of the charge (or end gas). Because of the dilution of the end gas, it will burn only when the flame front reaches it, thus preventing the premature ignition due to the pressure rise caused by the advancing flame front that is the usual characteristic of low-octane fuels, and thereby preventing the incipient detonation associated with the use of these low-octane fuels.

The same principle may be applied to fuel-injected engines, wherein the fuel is injected into the intake manifold, usually near the intake port, when required. In this case, the undiluted portion of the charge may simply be air, and the diluted portion may be an air-exhaust gas mixture, with the fuel being added to the charge as needed while it is being inducted into the cylinder.

The prestratification described above is applicable not only to normally aspirated engines but to supercharged engines as well. Supercharging involves the compression of the incoming air or air-fuel mixture to a level above ambient pressure to increase the volumetric efficiency of an I.C. engine and thus to increase its output power. The principal types of superchargers are internal gear-driven or belt driven type which are driven by the engine crankshaft, and the external exhaust gas turbine-driven type, or turbocharger. The present invention will be described herein in terms of its application to either a naturally aspirated engine or a turbocharged engine, but it will be understood that such descriptions are not limiting, but are for purposes of illustration only.

Although the present disclosure refers to the prestratification process in terms of the pressure of the normal portion of the charge with respect to the pressure of the diluent supplied to the diluted portion, it will be understood that this is for convenience in describing the relative quantities of the diluted and undiluted charge, and that other measures of quantity, such as the relative volumes of the respective charge portions, could be used. It should also be noted that the diluent gas may be supplied continuously or intermittently. If the former, then a portion of diluent gas will also be added to the normal portion of the charge, although not in the amount supplied to the diluted portion, and not in sufficient quantity to adversly affect the combustibility of the normal portion of the charge.

Combustion control by prestratification has the immediate effect of eliminating the knock or ping in present spark ignition engines which is due to incipient detonation. More importantly, combustion control by prestratification allows an increase in engine compression ratios and hence efficiency without increasing the octane rating requirements of the engine, thus more effectively utilizes existing fuels. Additionally, by eliminating knock, the present invention will allow the utilization of domestically available fuels, such as coal oil or kerosene, in presently produced engines, thereby reducing dependence on foreign oil supplies and reducing refining costs.

BRIEF DESCRIPTION OF THE DRAWINGS

While the patentable features of the control of combustion by prestratification are set forth with particularity in the appended claims, a full and complete understanding of the foregoing objects, features, and advantages of the invention may be had by referring to the description of the preferred embodiments thereof as set forth hereinafter and to the accompanying drawings in which:

DESCRIPTION OF PREFERRED EMBODIMENTS

Figure 1:
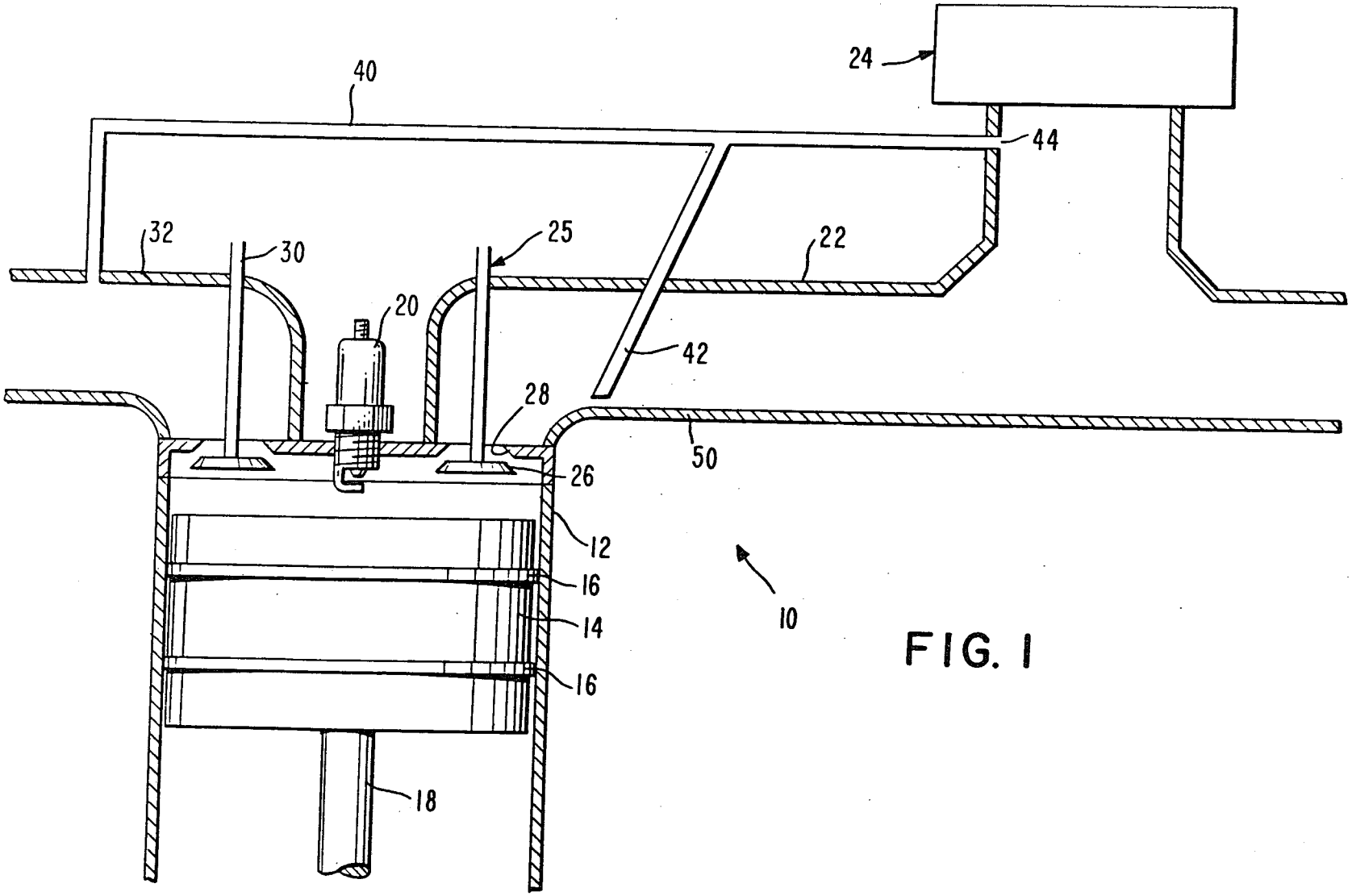
FIG. 1 is a schematic view, partly in section, of an engine employing combustion control by prestratification in accordance with the present invention.

In internal combustion engines, the characteristics of fuel combustion dictate many of the operating parameters and these parameters can be affected by mixing fuel additives such as tetra-ethyl lead for control of knock, the use of special fuel blends for winter and summer or for geographic location, and the like. Other factors, involving the mechanical structure of the engine, also strongly affect the operational characteristics, but unlike the use of various additives and blends of fuel, these features are not easily changed to meet varying needs. Therefore, as the octane rating of available fuel changes due to shortages, or to cost, it becomes more difficult to maintain the desired level of operation in existing engines. In accordance with the present invention, however, the problem of varying fuel characteristics is overcome by the dilution of the air-fuel mixture with air, exhaust gas, or other diluent gases in such a way as to obtain a stratified charge within the engine combustion chambers.

In considering the effectiveness of the stratification process herein disclosed, it should first be understood that two compression ratios characterize any given fuel and dictate its usefulness in engine applications. The first is the "critical compression ratio", or C.C.R., which is the minimum compression ratio necessary for the air-fuel mixture to burn spontaneously. For 60 octane gasoline, the C.C.R. is about 11 and for 80 octane gasoline about 14. For methane the C.C.R. is greater than 15 while for kerosene the C.C.R. is about 7.5. In spark ignition engines, the second compression ratio of interest is the "permissible compression ratio", or P.C.R., (sometimes referred to as the "highest useful compression ratio" or H.U.C.R.), which for a given fuel is limited by the onset of "knock", or uncontrolled combustion leading to an undesirable pressure rise rate, this rate being sufficiently fast to generate a noise described as a "ping" and labelled "incipient detonation". The P.C.R. is always lower than the C.C.R. and limits the compression ratio of the engine operating with that fuel. Engine efficiency is determined by the compression ratio. For the ideal Otto cycle, the efficiency $$\eta = 1 - \frac{1}{(CR)^{\gamma-1}}$$

where $\gamma$ is the ratio of the specific heat at constant pressure Cp to that at constant volume $C_v$, $\gamma = C_p/C_v$. Limitation of the compression ratio, and thus of engine efficiency, is not desirable. The P.C.R. depends on a multitude of operating parameters but present day gasoline has a P.C.R. of 8, kerosene a P.C.R. of 5, and methane a P.C.R. of 8. If an engine could be operated at its C.C.R. rather than its P.C.R., an increase in efficiency would result.

The P.C.R. is less than the C.C.R. since the last gases to be burned (end gas) by the flame front initiated by the ignition source (spark plug) are compressed not only by the piston during the compression stroke of the engine but also by expanding gases that have burned on passing through the flame front prior to the arrival of the flame front at the end gas. This occurs because the rate of propagation of the flame front, which is determined by temperature gradients, heat conductivity, and heat capacity in the flame front, is less than one-tenth the speed of sound in the gas, which determines the rate at which pressure is equalized. The combustion process across the flame front is essentially one of constant pressure, and the pressure rises uniformly throughout the combustion chamber as the flame front advances into the unburned mixture. The gas ahead of the flame front is compressed isentropically by the piston motion and also by the gas engulfed in the advancing flame front so that the end gases, which are subjected to the greatest pressure and temperature rises before combustion and during the engine cycle, will be the first to self-ignite. As the compression ratio of the engine is increased, the likelihood of self-ignition of the end gases increases. Thus, if the end gas temperature can be reduced by selective dilution so as to prevent premature self-ignition, "knock" will be controlled and more efficient engines made possible.

To discuss the process quantitatively, certain properties of engines operating on the ideal Otto cycle will be derived. Consider an advancing flame front progressing into unburned gases, b, behind which are burned gases, a.

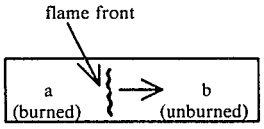

The internal energy U is made up of $U_a$ and $U_b$ and if one assumes perfect gases so $U_a = M_a C_v T_a$ where $M_a$ is the mass of a and $T_a$ is the temperature of a, then $$U = U_a + U_b = M_a C_v T_a + M_b C_v T_b.$$

Since the pressure P is uniform throughout the chamber, $P_a = P_b = P$ where $$P_a = \frac{M_a R T_a}{V_a} \text{ and } P_b = \frac{M_b R T_b}{V_b}$$

and the volume V is $V = V_a = V_b$, so $$U = C_v\left[\frac{P_a V_a}{R} + \frac{P_b V_b}{R}\right] = \frac{C_v}{R}[P_a V_a + P_b V_b] \quad (1)$$

$$U = \frac{C_v}{R} P(V_a + V_b) = \frac{C_v}{R} PV. \quad (2)$$

where R is the gas constant. In the ideal cycle it is assumed that heat is added at constant volume, so that the flame front traverses the gas while the piston is essentially at top dead center (T.D.C.). From the first law of thermodynamics, $Q = \Delta U + \delta W$ where Q is the total heat added and $\delta W$ is the work done. Since $\delta W = pdV = 0$, then $Q = \Delta U = (C_v/R)\, V\Delta p$, using the expression for U above.

Thus the pressure rise depends only on the heat added when V is constant. This result can be extended to include multiple gases, rates of heat release, or layers with varying composition and in all cases the result is the same. Because the pressure rises uniformly in the chamber, the pressure rise is always proportional to the heat released at constant volume. Since the cycle work W is the efficiency $\eta$ multiplied by the heat added Q from burning the fuel, and since the efficiency depends only on the compression ratio CR, then for a given work or engine power output the heat added should always be the same overall regardless of the details of the combustion process or processes in this idealized case of heat addition at T.D.C. Therefore, the total pressure rise $\Delta p$ due to combustion should also be the same.

The pressure rise experienced by the very last end gas, which is the pressure rise due to the compression stroke plus the pressure rise due to the advancing flame front, can be calculated. If the end gas temperature is $T_e$, and $P_c$ is the pressure at the end of the compression stroke, and if $P_o$ is the inlet or manifold pressure and $T_o$ the inlet temperature, then $$\frac{T_e}{T_o} = \left[\frac{P_c + \Delta P}{P_o}\right]^{\frac{\gamma-1}{\gamma}} \quad (3)$$

Using the previously derived relation between heat added and pressure rise for complete combustion, where Q is the total heat added, and q is the heating value of the fuel per unit mass, $$Q = \text{fuel mass}\,\frac{\text{heating value}}{(\text{fuel mass})} = \{\rho_o V_o\}\frac{F}{A}\,q = \frac{C_v}{R}\,V\Delta P\left(1 + \frac{F}{A}\right)$$

where $V_o$ is the engine cylinder volume, $\rho_o$ the intake density, and F/A the fuel-air ratio. Since $CR = (V_o/V)$ and $P_o = \rho_o R T_o$, then $$Q = \left\{\frac{P_o V_o}{R T_o}\right\}\frac{F}{A}\,q = \frac{C_v}{R}\,\frac{V_o}{(CR)}\,\Delta P\left(1 + \frac{F}{A}\right) \text{ or} \quad (4)$$

$$\Delta P = \frac{(CR)}{\left(\frac{A}{F} + 1\right)}\left(\frac{q}{C_v T_o}\right) P_o$$

The $C_v$ used here for combustion should be about $$C_v = 0.25\,\frac{\text{BTU}}{\text{Lb. °R.}}$$

The heating value of hydrocarbon fuels is about 18000 BTU/lb. and the air-fuel ratio at equivalence ratio $\phi = 1$ is about 15 (A/F=15) so that q, or heat released on combustionper pound of fuel is 18000 BTU/lb. and $$\frac{q}{C_v(1 + A/F)} = 4500° \text{ R.} = \Delta T_c$$

where $\Delta T_c$ is the temperature change in the combustion chamber on constant volume combustion. If we arbitratily choose $T_o$ equal to 80° F. or 540° R, then $$\Delta P = \frac{CR}{16} \frac{18000}{(0.25)(540)} P_o = (CR)(8.33) P_o \quad (5)$$

The above derived formulas can now be utilized in a specific example. Consider an engine which operates on kerosene at a compression ratio of 5 and a manifold or inlet pressure (assuming no charge dilution from the previous cycle) of $P_o$, then using $\Delta P = (CR)(8.33)P_o$ yields a $\Delta P$ of $41.67P_o$ and using $$\frac{T_e}{T_o} = \quad (6)$$

$$\left(\frac{P_c}{P_o} + \frac{\Delta P}{P_o}\right)^{\frac{\gamma-1}{\gamma}} \text{ yields } \frac{T_e}{T_o} = [(CR)^\gamma + 41.67]^{\frac{\gamma-1}{\gamma}}$$

If $\gamma = 1.4$ then $T_e/T_o = 3.08$ or $T_e = 1662°$ R $= 1202°$ F., since $T_o$ was assumed to be 80° or 540° R.

For the same engine, operating on kerosene at a compression ratio of CR*, but changing $P_o$ to $P_o$* by means of exhaust gas dilution, while keeping the same $T_o$, $T_e$, W and $V_o$ for the same knock performance at the same power, then:

$$W = \eta Q = \eta^* Q^* \text{ or } \eta P_o\left(\frac{F}{A}\right) = \eta^* P_o^*\left(\frac{F}{A}\right)^* \quad (7)$$

and $$\frac{P_c^*}{P_o^*} = (CR^*)^\gamma$$

so $$\left[(CR^*)^\gamma + \frac{(CR^*)q/C_vT_o}{\frac{A}{F}\frac{\eta^*}{\eta}\frac{P_o^*}{P_o} + 1}\right]^{\frac{\gamma-1}{\gamma}} = 3.08$$

From the foregoing it is seen that $$\frac{P_o^*}{P_o} = \frac{\eta}{\frac{A}{F}\eta^*}\left(\frac{133.33\ CR^*}{51.28 - (CR^*)}\gamma - 1\right)_{if\ \gamma=1.4} \quad (8)$$

Where $P_o$* is the intake manifold pressure that should be achieved by selective dilution of the charge for prestratification to obtain the same power and knock performance (i.e., the same temperature of the end gas) for different chosen compression ratios, CR*. Thus with the same knock restriction the engine can be operated at a higher CR, and thus with higher efficiency, if $P_o^*/P_o$ is made larger than 1. For example, for various ratios of exhaust gas dilution, the following compression ratios are attainable with the resulting efficiencies $\eta^*$ for kerosene with A/F=15:

TABLE I

| $P_o^*/P_o$ | CR* | $\eta^*$ |
|---|---|---|
| 1 | 5 | 0.47 |
| 1.21 | 6 | 0.51 |
| 1.46 | 7 | 0.54 |
| 1.76 | 8 | 0.56 |

These results indicate that by increasing the intake manifold pressure to a level above that of a conventionally aspirated engine by the addition of recirculated exhaust gas or other diluent gases to the intake manifold so that the ratio $P_o^*/P_o$ is increased to 1.76 a fuel such as kerosene can be used in an engine havng a compression ratio of 8 and with a resulting engine efficiency of 0.56, whereas previously such a fuel could only be operated in an engine having a compression ratio of 5. Thus, the addition of exhaust gas to cause dilution of the end gases and to thereby control combustion and eliminate or severely inhibit knock will allow the use of a fuel such as kerosene having a P.C.R. of 5 to be used in an engine having a compression ratio of 8 if sufficient exhaust gas dilution in the form of charge prestratification is applied to increase the intake manifold pressure to about twice its conventional level.

The ratio of manifold pressures $P_o^*/P_o$ is utilized in this calculation as it is a readily detectable indication of the amount of exhaust gas being added to the charge but the amount of diluent added could be determined in other ways, for example by measurement of, and control of, the volume of diluent gas added to the charge. It should be remembered that the diluent gas is used to control combustion by prestratification so that the charge introduced into the cylinder is added in a stratified configuration.

Utilizing the same formulas as discussed above for gasoline which will operate in a conventional engine having a compression ratio of 8 when $P_o$* is equal to $P_o$, yields the following:

$$\Delta p = 66.67\ P_o$$

$(T_e/T_o) = 3.56$ or $T_e = 1922°$ R or 1462° F.

By raising the ratio $P_o^*/P_o$ through the addition of exhaust gas prestratification to the intake manifold, the following values can be calculated:

TABLE II

| $P_o^*/P_o$ | CR* | $\eta^*$ |
|---|---|---|
| 1 | 8 | 0.56 |
| 1.76 | 12 | 0.63 |
| 3.22 | 16 | 0.67 |

These calculations indicate that by prestratification through the addition of exhaust gas to the intake manifold, the gasoline could be burned in an engine with a compression ratio approaching 16 if the manifold intake pressure were tripled by the addition of sufficient exhaust gas diluent. This compression ratio, and hence the efficiencies of diesel engines, can thus be obtained from a spark ignition internal combustion engine through the control of combustion by prestratification caused by the addition of exhaust gas to the intake manifold in a sufficient amount and at the proper location.

To verify the above calculations, tests were run on a 258 cubic inch American Motors Corporation 6-cylinder engine having a compression ratio of 8. Recirculated exhaust gas was utilized to prestratify the charge before it entered the combustion chamber in such a manner that the end gases, which in this engine are those closest to the piston head and farthest away from the spark plug, received the portion of the charge which had been diluted by the exhaust gas. Ordinarily, increasing the intake manifold pressure with exhaust gas for conventional EGR pollution control is restricted to about a 10% increase. However, it has been found that because unburned gas in the combustion chamber is preheated by the flame front, as described above, its tolerance for exhaust gas is increased, and the prestratification of the present invention can be used to make $P_o^*/P_o$ much greater than 1.10.

With the timing set at 10° before top dead center, the engine was run using kerosene, Jet A, JP-4, etc. as a fuel. The octane rating for this fuel is quite low, generally in the range of 40, so that the permissible compression ratio (P.C.R.) for kerosene in a conventional engine is in the range of 3.5 to 5.5.

By using combustion control by prestratification with exhaust gas the following readings were noted. The conventional values using gasoline and no prestratification are shown in parenthesis.

| Speed | Intake Manifold Pressure Inches of Mercury | M.P.G. | $P_o^*/P_o$ |
|---|---|---|---|
| 25 MPH | 25.5 (14.5) | 26 (24) | 1.76 |
| 50 MPH | 24 (16.5) | 24 (21) | 1.45 |

The engine was observed to run smoothly and quietly at 25 MPH with no audible indication of ping or knock. The ratio of $P_o^*/P_o$ compares with the calculated values set forth previously in Table I for Kerosene. At speeds above 50 MPH the onset of knock could be detected. This was explained by the fact that at this speed the ratio of $P_o^*/P_o$ was reduced to 1.45, thus indicating the availability of less exhaust gas diluent for charge prestratification, and from Table I it can be seen that such a ratio requires a lower compression engine. This test demonstrated that a conventional gasoline engine can be caused to operate satisfactorily on kerosene, or other low octane fuels, by the use of combustion control by prestratification with exhaust gas in accordance with the present invention. The above considerations can be made generally for any desired set of parameters giving $$\frac{P_o^*}{P_o} = \frac{\eta PCR}{\eta^*(A/F)PCR}\left[\frac{CR^*(q/C_vT_o)}{(PCR)\frac{q}{C_vT_o}\frac{1}{\left(\frac{A}{F}+1\right)_{PCR}} + (PCR)^\gamma - (CR^*)^\gamma} - 1\right] \quad (9)$$

Referring now to FIG. 1, there is illustrated a first embodiment of a spark ignition internal combustion engine 10 utilizing prestratification by exhaust gas for combustion control to eliminate knock or incipient detonation in accordance with the present invention. FIG. 1 is a schematic illustration of only a portion of one cylinder of the engine, and it will be understood that this engine is generally conventional in structure except for the prestratification feature of the invention.

Engine 10 includes a cylinder 12 in which is carried a reciprocating piston 14. Piston 14 carries known compression sealing rings 16 and transmits power through a connecting rod 18 to the crankshaft of the engine (not shown). A spark plug 20 is secured in the upper portion of the cylinder and functions in a conventional manner to ignite a charge of fuel and combustible gas compressed in the cylinder 12 by reciprocation of the piston 14. It will be understood that the disclosed engine operates on the well known Otto cycle.

The charge is fed into the cylinder 13 through an intake manifold 22. This charge may, for example, be air and fuel mixed in a conventional carburetor 24 secured to the intake manifold or may be air into which fuel is injected at a suitable location, such as adjacent the intake valve, the particular manner in which the fuel and air are mixed not being a part of this invention. An intake valve 25 is mounted in the intake manifold and has a valve head 27 which cooperates with an intake port 28 in the top of cylinder 12 to control the flow of combustion materials into cylinder 12 from intake manifold 22 in a conventional manner. An exhaust valve 30 is also provided in the cylinder and opens to allow a flow of combustion products in the form of exhaust away from the cylinder through an exhaust manifold 32. The above-described engine normally operates with gasoline and air, and the fuel and air mixture usually is supplied at a ratio of about 1 to 15.

It will be understood that the working gas used in the present invention is generally air, and for convenience the mixture supplied in this embodiment by the carburetor will be referred to as a fuel-air mixture, but any combustion supporting gas can be used. In addition, while only one cylinder has been set forth, it will be understood that this is only for purposes of illustration and that the engine may well have a number of similar cylinders all of the same general configuration and all in communication with the above-disclosed or similar intake and exhaust manifolds 22 and 32, respectively, and with the carburetor 24.

As discussed above and as illustrated in FIG. 1, combustion control by prestratification is accomplished in the present invention by means of a diluent gas which is supplied to the intake manifold adjacent the intake valve port 28. While the diluent gas will, for convenience, be described and hereafter referred to as exhaust gas, it will be understood that dilution of the charge for prestratification can be accomplished by other gases, such as air. Dilution is accomplished, in the disclosed embodiment of the invention, by feeding a portion of the exhaust gases in the exhaust manifold 32 through an exhaust gas recirculation line 40 to an exhaust gas prestratification port or nozzle 42. If desired, additional exhaust gas may be fed to a conventional exhaust gas recirculation system through an E.G.R. port 44 adjacent the throttle vave of carburetor 24.

As may be seen in FIG. 1, the exhaust gas prestratification nozzle 42 extends into the intake manifold at a point generally adjacent the intake valve 25, near the intake port 28. In a preferred embodiment, the prestratification nozzle 42 is so positioned that it will be angled with respect to a lower surface portion 50 of the intake manifold where a layer of liquid fuel tends to form. This positioning of port 42 allows the recirculated hot exhaust gas to vaporize any such accumulation of fuel in the manifold.

The size of the exhaust gas prestratification nozzle 42, and thus the rate of flow of exhaust gas, as well as its exact location will vary with engine configuration,. The size is selected in accordance with the amount of exhaust gas prestratification desired and the increase in intake manifold pressure needed for combustion control. The intake manifold pressure is normally governed by the carburetor throttle plate, by the manifold construction and by the design of any supercharging equipment used, and the fuel-air mixture normally is carried in the manifold at a given first pressure. By the addition of exhaust gas diluent at a second pressure which is higher than the first pressure, the net pressure in the intake manifold will be increased. As discussed previously, the ratio of the first and second pressures is an indication of the amount of exhaust gas for prestratification being used for combustion control.

In operation of the prestratification system illustrated in FIG. 1, after the intake valve 25 has closed a quantity of the fuel-air mixture from the carburetor remains stationary in the intake manifold. Exhaust gas is fed through the nozzle 42 from the exhaust manifold 32 and is injected into the intake manifold to dilute any fuel-air mixture remaining in the portion of the intake manifold 22 which is near the now-closed intake valve 25. As discussed previously, the exact amount and pressure of the exhaust gas used for this charge prestratification will vary, depending on engine configuration and the fuel being used. The injected exhaust gas vaporizes a portion of the liquid fuel on the lower surface 50 of the manifold and, in addition, creates a pocket or region adjacent the intake valve in which the fuel-air mixture is diluted by the exhaust gas, the remaining portion of the fuel-air mixture in the intake manifold being substantially undiluted. This pocket of diluted fuel-air mixture cooperates with the undiluted mixture to produce a prestratification of the charge which is to be delivered to the cylinder when the intake valve opens.

As the intake valve 25 opens and piston 14 travels downwardly on its intake stroke, the gaseous mixture in the intake manifold starts to flow into the cylinder, and the pocket of mixed fuel, air and exhaust is drawn into the cylinder. This diluted mixture forms the first portion of the cylinder charge, which occupies the region of the cylinder 12 farthest from spark plug 20, generally in the region of piston 14. The second portion of the charge, which immediately follows the first portion, is formed by the substantially undiluted fuel-air mixture drawn from the carburetor, and this second portion occupies the remainder of the cylinder. It will be noted that the fuel-air mixture from the carburetor which forms the second portion of the charge is drawn past the prestratification nozzle 42, and thus will receive some diluent gas, in an amount which is allowed for in the design of port 44 and/or nozzle 42. This substantially undiluted portion of the charge enters the cylinder and is located in the portion thereof which is closer to the spark plug 20. After the intake valve closes the charge in the cylinder remains generally in the prestratified condition in which it was admitted to the cylinder during the compression stroke of the piston.

Upon ignition by the spark plug, a flame front is created in the charge adjacent the plug and moves substantially uniformly outwardly. As was discussed previously, the compression stroke of the piston together with combustion of the charge in the cylinder causes a pressure rise in the yet unburned portions of the charge in the cylinder which, with fuels having a relatively low octane rating, would normally cause incipient detonation of the end gases; i.e. of the portion of the charge located in the region of the cylinder furthest away from the spark plug. However, because of the dilution of the end gases by prestratification, these gases will not support combustion in the absence of a flame, and thus they will not tend to detonate under the increased pressure created by the flame front and by the compression stroke of the cylinder. Accordingly, incipient detonation, or knock, is prevented and the complete charge combusts properly.

After combustion, the exhaust valve 30 is opened and the combustion products are exhausted, a portion of these exhaust gases being returned to the intake manifold adjacent the intake valve 25 through the exhaust gas prestratification port 42 and the remainder of the exhaust gases passing into the atmosphere.

As indicated above, the compression ratio CR that can be used with a specified fuel can be described in terms of the total pressure rise $\Delta p$ which occurs due to the compression stroke of the engine, thereby providing a "total pressure rise" factor $R_k$, where $$R_k = \frac{P_c + \Delta P}{P_o}, \text{ or } [\Delta P]_{max} = R_k P_o - P_c$$

and where $P_o$ is the intake manifold pressure and $P_c$ is the pressure in the cylinder at the end of the compression stroke. If it is then desired to supercharge the engine, as by the addition of a turbocharger of the type schematically illustrated in FIGS. 2 and 3, the pressure within the cylinder will be changed. If the pressure rise across the compressor of the turbocharger is $\pi_s$, then $$[\Delta P]_{max} = R_k P_o - P_c = R_k P_o - \pi_s (CR)^{\gamma} P_o \quad (10)$$

$$= \frac{(CR)\,[MP]}{1 + (A/F)_M} \; \frac{Q_f}{C_v T_m} \quad (11)$$

Where $(A/F)_M$ is the minimum air fuel ratio allowed so that $[\Delta P]_{max}$ is not exceeded, and MP is the manifold pressure.

Since $MP = \pi_s P_o$, $Q_f$ is BTU per lb. of fuel (heating value), $C_v$ is the specific heat at constant volume, and $T_m$ is $$T_o \pi_s \frac{\gamma - 1}{\gamma},$$

then:

$$1 + \left(\frac{A}{F}\right)_M = \frac{(CR)\left(\frac{Q_f}{C_v T_o}\right)\pi_s^{1/\gamma}}{R_k - \pi_s (CR)^{\gamma}} \quad (12)$$

The total pressure rise factor $R_k$ can be determined for a given fuel by measuring its permissible compression ratio (P.C.R.). For a given $R_k$, the compression ratio (CR), pressure rise $\pi_s$ across the turbocharger, and the air-to-fuel ratio A/F are restricted by the relationship (12) given above. For a given spark ignition engine, the permissible A/F ratio is usually known, and is determined by the spark plug ignition characteristics. Thus, $\pi_s$ determines the maximum permissible compression ratio CR for the particular fuel being used, and determines the maximum work done, or power, if the engine speed is known. Accordingly:

$$\frac{W_{max}}{V_b} = \eta \frac{\left(\frac{Q_f}{RTM}\right)(MP)}{(A/F)_M} \tag{13}$$

A convenient parameter for use in comparing engine is the "mean effective pressure" (M.E.P.), which is defined as the pressure that, when multiplied by the piston displacement, gives the work W. That is:

$$(MEP)(V_b - V_c) = W = (MEP)V_b\left(1 - \frac{V_c}{V_b}\right) \tag{14}$$

where $V_b$ is the initial volume of the cylinder and $V_c$ is the volume remaining after the compression stroke, at top dead center. The foregoing formula may also be stated as follows:

$$\frac{W}{V_b} = (M.E.P.)\left(1 - \frac{1}{CR}\right) = (M.E.P.)\frac{CR - 1}{CR} \tag{15}$$

so that $$(M.E.P.)_{max} = \frac{\eta\left(\frac{Q_f}{RTm}\right)\left(\frac{CR}{CR - 1}\right)[MP]}{(A/F)_M} \tag{16}$$

If the engine is turbocharged, it exhausts into a back pressure created by the turbine; however, the pressure supplied by the turbocharger compressor pushes on the piston during the intake stroke to produce additional work from the engine. The ideal turbine inlet temperature $T_t$ is the same as the engine "outlet" temperature $T_c$ at the engine exhaust valve, even if the outlet pressure is throttled (constant enthalpy), so that:

$$\frac{T_t}{T_b} = \frac{p_e}{p_b} = \frac{R_k}{(CR)^\gamma}\ \frac{1}{\pi_s} \tag{17}$$

In the ideal case the turbine work must equal the compressor work:

$$T_t - T_x = T_b - T_o, \tag{18}$$

where $T_x$ is the temperature of the exhaust gases leaving the turbine. Therefore:

$$T_x = T_t + T_o - T_b, \tag{19}$$

$$T_b = T_o\pi_s^{\frac{\gamma-1}{\gamma}}, \tag{20}$$

and $$\pi_t = \left(\frac{T_t}{T_x}\right)^{\frac{\gamma}{\gamma-1}} \tag{21}$$

where $\pi_t$ is the pressure ratio across the turbine.

Accordingly:

$$T_x = \frac{R_k T_o}{\pi_s^{1/\gamma}(CR)^\gamma} + T_o - T_o\pi_s^{\frac{\gamma-1}{\gamma}} \tag{22}$$

and:

$$\left[\pi_t = \frac{\frac{R_k}{\pi_s^{1/\gamma}(CR)^\gamma}}{\frac{R_k}{\pi_s^{1/\gamma}(CR)^\gamma} + 1 - \pi_s^{\frac{\gamma-1}{\gamma}}}\right]^{\frac{\gamma}{\gamma-1}} \tag{23}$$

The extra work $W_{e\,L}$ *due to turbocharging is thus:*

$$W_e = p_o(\pi_s - \pi_t)(V_b - V_c) \tag{24}$$

$$= (M.E.P.)_p(V_b - V_c) \tag{25}$$

Accordingly, the total M.E.P. for the turbocharged engine is:

$$(M.E.P.)_t = \{(M.E.P. + (\pi_s - \pi_t)\}P_o \tag{26}$$

That is, $M.E.P._t$ is the turbocharged engine M.E.P. for comparison purposes.

But in a turbocharged engine, the engine work is increased for the same heat Q, since the turbocharger makes use of the waste heat from the engine. Thus, the engine efficiency $\eta_e$ is greater:

$$\eta_e = \eta\frac{(M.E.P.)_t}{M.E.P.} \tag{27}$$

Considering the case of a present day unleaded gasoline, where $R_k = 85$, for example, and selecting $T_o = 540°R$;

$$C_v = 0.25\ \text{BTU/lb. °R.};\ R = \frac{2\ \text{BTU}}{29\ \text{lb. °R.}};$$

and $Q_f = 18{,}000$ BTU/lb., then:

$$\left(\frac{A}{F}\right)_M = \frac{133.33\,(CR)\pi_s^{1/\gamma}}{85 - \pi_s(CR)} - 1 \tag{28}$$

$$M.E.P. = \frac{483.33\eta\left(\frac{CR}{CR - 1}\right)\pi_s^{1/\gamma}}{\left(\frac{A}{F}\right)_M}P_o \tag{29}$$

$$\pi_t = \left[\frac{85}{85 - \pi_s CR^\gamma + \pi_s^{1/\gamma}CR^\gamma}\right]^{\frac{\gamma}{\gamma-1}} \tag{30}$$

From the foregoing it will be seen that since the increased efficiency of a turbocharged engine is proportional to its increased mean effective pressure over the standard MEP of a naturally aspirated engine, and the other parameters of the engine are similarly proportional, then a stratified charge combination control is applicable to turbocharged (and other supercharged) engines as well as naturally aspirated engines. The application of prestratification to a turbocharged engine is illustrated diagrammatically in FIGS. 2 and 3, in which elements similar to those of FIG. 1 are similarly numbered.

Figure 2:
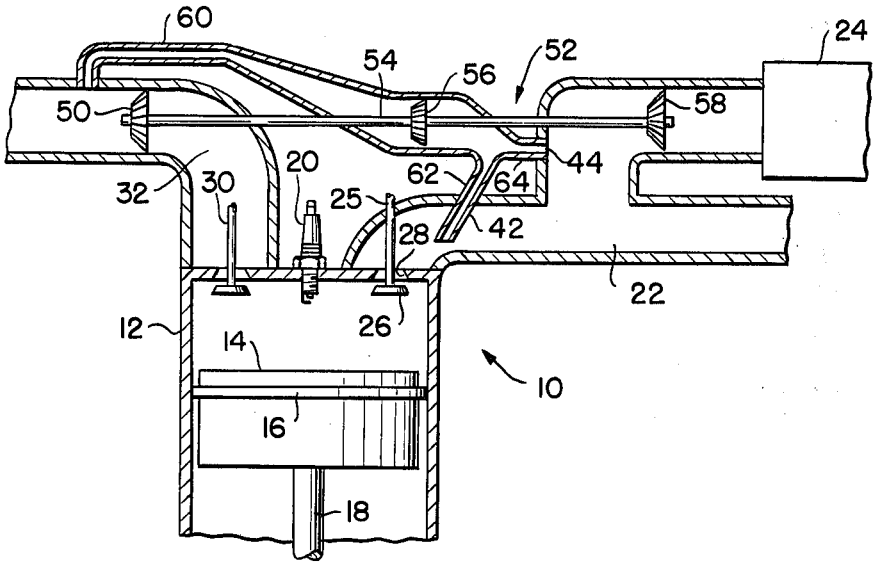
FIG. 2 is a schematic view, partly in section, of a turbocharged engine wherein exhaust gas downstream of the turbocharger is supplied to the engine intake through a stage of the turbocharger.
Figure 3:
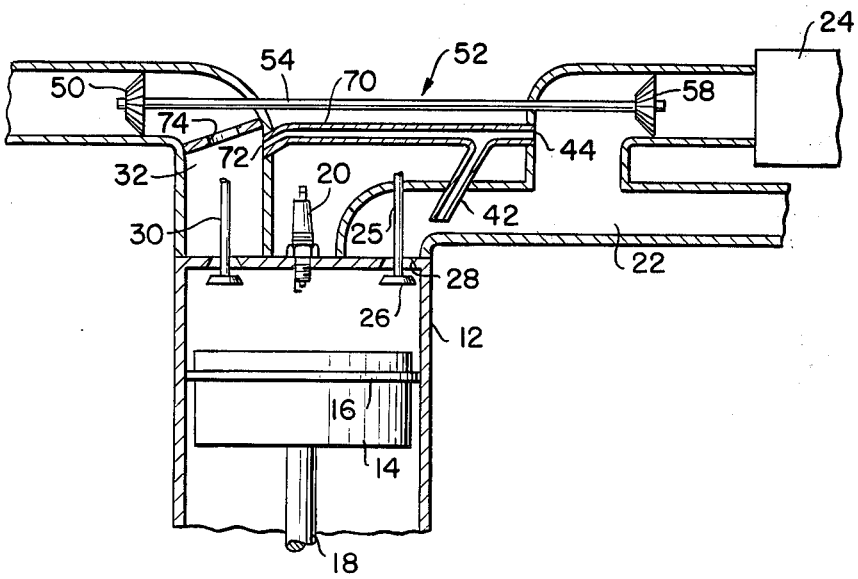
FIG. 3 is a schematic view, partly in section, of a turbocharged engine wherein exhaust gas is supplied directly to the engine intake from the engine exhaust outlet.

In FIG. 2, the outlet of exhaust manifold 32 is illustrated as being extended to incorporate the drive turbine 50 of a turbocharger generally indicated at 52. The turbine is carried on a shaft 54 whichis common to, and which carries, two compressor stages 56 and 58. The compressor 58 is mounted within the intake manifold 22 in conventional manner and is driven by turbine 50 at a relatively high rotational speed to force air or the air-fuel mixture from the carburetor 24 into the engine intake.

Combustion control by prestratification is accomplished in the turbocharged engine by means of the exhaust gas prestratification nozzle 42, as before. In addition, conventional exhaust gas recirculation may also be provided through EGR port 44. In the turbocharged engine, however, the recirculated exhaust gas is fed to nozzle 42 and port 44 by way of an exhaust gas recirculation line 60, which feeds exhaust gas through the compressor stage 56 of the turbocharger 52. The compressor increases the pressure of the exhaust gas, which is then fed by way of recirculating lines 62 and 64 to nozzle 42 and port 44, respectively. The exhaust gas is thus raised to the pressure required to produce stratification and conventional EGR, in the manner discussed above, with the nozzle 42 being so located and so sized as to produce the rate of exhaust gas flow required and to control the location of the gas in the intake manifold in accordance with the amount of prestratification desired. As indicated above, the pressure of the prestratification gas is slightly higher than the pressure of the fuel-air mixture in the manifold, so that the prestratification gas is properly positioned in the intake manifold.

In another embodiment of the turbocharged engine, prestratification is obtained without the need for a separate exhaust gas compressor stage in the turbocharger. In this arrangement, the turbocharger 52 includes a turbine 50 located at the outlet of the exhaust manifold 32 driving by way of shaft 54 a compressor 58 in the intake manifold. This produces an elevated pressure in the intake manifold 22 as well as an elevated pressure in the exhaust manifold 32.

Combustion control by prestratification is accomplished in this embodiment by means of an exhaust gas recirculation line 70 which supplies exhaust gas to the EGR port 44 and to the prestratification nozzle 42. An inlet 72 to the recirculation line 70 is located in the outlet of the exhaust manifold, upstream of the turbine 50. The desired pressure level for the recirculation line is maintained in the exhaust manifold by means of a restricting orifice 74 in the outlet from mainfold 32, the orifice being located downstream from the inlet 72. The size of orifice 74 is selected to retain the pressure level in the recirculation line that is required to produce an exhaust gas pressure at nozzle 42 that is slightly higher than the air-fuel pressure within the intake manifold, so that a pocket of exhaust gas will form in the area of the intake port, for prestratification prior to the intake stroke of the cylinder. Stratification is maintained in the cylinder during the commpression stroke, as described above. It will be understood that in order to maintain this stratification during the intake and compression strokes a cylinder configuration that is designed to create swirling and mixing effects is to be avoided.

While the combustion control by prestratification using exhaust gas in accordance with the present invention has been set forth for use in a carbureted reciprocating piston engine, it will be obvious that such combustion control could also be utilized in other engine configurations such as rotary, and could be used with fuel injection. Further, as was discussed previously, the exact location of the prestratification port 42, the pressure of the exhaust gases required to prestratify the charge, and hence, the specific size and shape of the exhaust gas prestratification nozzle will vary in response to engine configuration and the fuel to be burned. Furthermore, while a preferred embodiment of an engine employing combustion control by prestratification using exhaust gas has been hereinabove fully and completely disclosed, it will be obvious to one of ordinary skill in the art that a number of changes in, for example, the structure of the intake and exhaust manifolds, the number of engine cylinders, the type of carburetion used and the like could be made without departing from the true spirit and scope of the invention, and accordingly it is desired that the invention be limited only by the following claims:

What is claimed is:

1. A method of controlling detonation in supercharged internal combustion engines working in the Otto cycle, to permit use of low octane fuel in such internal combustion engines having a compression ratio exceeding the permissible compression ratio of the fuel, whereby the engine efficiency is improved, comprising:

supplying a charge to the intake manifold of a supercharged internal combustion engine, said charge utilizing a fuel having a permissible compression ratio less than the compression ratio of said engine, said charge being supplied at a first pressure;

supplying a diluting gas to the intake manifold of the engine at a location near the intake port of a combustion chamber for the engine, said diluting gas being at a second pressure which is higher than said first pressure to dilute a portion of the charge within the intake manifold and to thereby prestratify the charge to be delivered to the combustion chamber;

feeding the diluted portion of the charge followed by a substantially undiluted portion of the charge to the combustion chamber while maintaining stratification to produce an end gas diluted portion of the charge within said combustion chamber at a location remote from the charge ignitor;

and igniting said charge to produce a flame front which moves from the ignition point through said combustion chamber to said end gas, the dilution of said end gas due to prestratification producing a reduced temperature in said end gas to prevent detonation.

2. The method of claim 1, wherein the ratio of said second pressure with respect to said first pressure is between about 1.5 and 3.

3. The method of claim 1, wherein said diluting gas is recirculated exhaust gas.

4. The method of claim 1, wherein said diluting gas is air.

5. The method of claim 1, wherein the ratio of said second pressure with respect to said first pressure is sufficient to produce an end gas that burns without knock.

6. A method of controlling combustion in a spark ignited turbocharged internal combustion engine to allow the engine to operate knock-free on a fuel having an octane rating lower than that required by the engine in the absence of said method of combustion control, said method comprising:

compressing by means of a first compressor stage of a turbocharger a charge to be delivered to a combustion chamber of an internal combustion engine;

introducing said charge into an intake manifold of said engine;

compressing by means of a second compressor stage of a turbocharger a diluent gas;

introducing said compressed diluent gas into said intake manifold adjacent an intake port for said combustion chamber, said diluent gas diluting said charge in a region adjacent said intake port to prestratify said charge;

introducing said prestratified charge into said combustion chamber of the engine upon opening of said intake port while maintaining the stratification of said charge, said portion of said charge diluted with said diluten gas being disposed in said combustion chamber substantially at a location furthest from a source of ignition;

igniting said charge to cause a flame front to burn through said charge, said portion of said charge containing said diluent gas being the last portion of said charge to burn, said diluent gas being supplied to said charge in sufficient quantity to prevent said diluted portion of said charge from prematurely burning prior to the arrival to said flame front, whereby incipient detonation is prevented.

7. A method of controlling combustion in a spark ignition, turbocharged, internal combustion engine to operate said engine at a high efficiency on a low octane fuel without detonating, said low octane fuel having a permissible compression ratio less than the compression ratio of said engine, said method of control comprising the steps of:

delivering by means of a turbocharger compressor stage a charge to an intake manifold portion of said engine at a first temperature controlling parameter;

diluting a portion of said charge adjacent an intake port portion of said intake manifold by addition of a diluent gas at a second temperature-controlling parameter to prestratify said charge in said intake manifold while said intake valve is closed;

opening said intake port to receive said prestratified charge into a cylinder of said engine while maintaining stratification thereof, said diluted portion of said charge being the first to enter said cylinder and being disposed further from the charge igniter in said cylinder;

igniting said charge to cause a flame front to burn through said charge, said diluted portion of said charge being prevented from spontaneously combusting by the addition of a sufficient amount of diluent gas whereby incipient detonation is prevented and the engine is caused to operate with increased efficiency on low octane fuel.

8. The method of claim 7, wherein said first temperature controlling parameter is a first pressure, and said second temperature controlling parameter is a second pressure, said second pressure being greater than said first pressure.

9. The method of claim 7, wherein said first temperature controlling parameter is a first volume, and said second temperature controlling parameter is a second volume which displaces a portion of said first volume.

10. A method of controlling combustion in a spark ignition, turbocharged, internal combustion engine, said engine including a cylinder in which is reciprocably carried a piston, an intake manifold having an intake valve for delivering a combustible fuel and air mixture to said cylinder at a first pressure, an exhaust manifold having an exhaust valve for removing exhaust gas from said cylinder, a turbocharger having a turbine driven by said exhaust gas and a compressor driven by said turbine, said compressor supplying said fuel and air mixture to said intake manifold, and a spark plug for igniting said fuel and air mixture in said cylinder, the control of combustion in said engine being accomplished by the steps of:

supplying a portion of said exhaust gas to said intake manifold adjacent said intake valve at a second pressure which is higher than said first pressure to prestratify said fuel and air mixture in said intake manifold;

transferring said prestratified fuel and air mixture and exhaust gas to said cylinder upon opening of said intake valve, said mixture being received in said cylinder in its stratified form; and igniting said mixture in said cylinder to cause a flame front to combust said mixture in a controlled manner whereby incipient detonation of the portions of said mixture at a location away from said spark plug is controlled.

11. The method of claim 10, wherein the step of supplying a portion of said exhaust gas to said intake manifold at a second pressure includes a compressing said portion of said exhaust gas in a second compressor driven by said turbine and delivering said compressed exhaust gas to a prestratification nozzle having an outlet located within said intake manifold adjacent said intake valve.

12. The method of claim 10, wherein the step of supplying a portion of said exhaust gas to said intake manifold at a second pressure includes restricting the flow of exhaust gas from said exhaust manifold upstream of said turbine to increase the pressure thereof, and recirculating a portion of said increased-pressure exhaust gas through a prestratification nozzle having an outlet located within said intake manifold adjacent said intake valve.

13. A method of operating a turbocharged internal combustion engine working in the Otto cycle to permit the use of fuels having a permissible compression ratio less than the compression ratio of the engine, the improvement which comprises:

delivering to the combustion chamber of said engine a prestratified charge having a first diluted portion differing in composition from a second relatively undiluted portion, said charge having a pressure $P_o$ in the absence of any dilution at a given power level of said engine said diluted portion being formed by the addition of diluent gas to increase the manifold pressure to a pressure $P_o^*$, said charge being delivered to said combustion chamber while maintaining the prestratification of said portions so that said first diluted portion is delivered to a point in said combustion chamber remote from the spark ignitor thereof, the pressure of said first diluted portion being increased by the introduction of the diluent by the ratio of $P_o^*/P_o$ defined as:

$$\frac{P_o^*}{P_o} = \frac{\eta_{PCR}}{\eta^* (A/F)_{PCR}} \left[ \frac{CR^* (q/C_vT_o)}{(PCR)\frac{q}{C_vT_o} \frac{1}{\left(\frac{A}{F}+1\right)_{PCR}} + (PCR)^\gamma - (CR^*)^\gamma} - 1 \right]$$

where CR* is the prestratification controlled compression ratio for the fuel; $\eta_{PCR}$ is the engine efficiency without prestratification; $(A/F)_{PCR}$ is the air fuel ratio without prestratification; $T_o$ the manifold inlet temperature; $C_v$ is the heat capacity at constant volume for combustion, q the heating value of the fuel; PCR is the permissible compression ratio without prestratification; $\eta^*$ is the engine efficiency with prestratification, and $\gamma$ is the ratio of specific heat at constant pressure to the specific heat at constant volume, and wherein the ratio $P_o^*/P_o$ is caused to be substantially larger than 1.1, whereby the temperature rise of said first diluted portion during compression and combustion is caused to be insufficient to produce knock.

14. A prestratified charge for a working cylinder of a turbocharged internal combustion engine operating on the Otto cycle, said charge enabling the engine to operate with a fuel having a permissible compression ratio less than the compression ratio of the engine, the charge comprising:

a first substantially undiluted portion having a pressure $P_o$ at a given power level of the engine, a second diluted portion differing in composition from said first portion by the addition of a diluent gas supplied to increase the manifold pressure to $P_o^*$, said second portion forming a region of diluent charge to produce a prestratification of the charge, the pressure of said diluted portion being increased by the addition of diluent gas by the ratio $P_o^*/P_o$ defined as $$\frac{P_o^*}{P_o} = \frac{\eta_{PCR}}{\eta^*(A/F)_{PCR}} \left[ \frac{CR^* (q/C_vT_o)}{(PRC)\frac{q}{C_vT_o} \frac{}{(A/F+1)_{PCR}} + (PCR)^\gamma - (CR^*)^\gamma} - 1 \right]$$

where CR* is the prestratification controlled compression ratio for the fuel, $\eta_{PCR}$ is the engine efficiency without prestratification; PCR is the permissible compression ratio without prestratification, A/F the air fuel ratio without prestratification, $C_v$ the heat capacity of the combustion mixture at constant volume; q the heating value of the fuel; $T_o$ the cylinder inlet or manifold temperature; $\eta^*$ is the engine efficiency with prestratification; and $\gamma$ is the ratio of specific heat at constant pressure to the specific heat at constant volume, and wherein the ratio $P_o^*/P_o$ is caused to be substantially larger than 1.1, whereby the engine will operate on said charge without knock.

* * * * *